US011059005B2

(12) United States Patent
Rüberg et al.

(10) Patent No.: US 11,059,005 B2
(45) Date of Patent: Jul. 13, 2021

(54) MIXING MACHINE

(71) Applicant: Dr. Herfeld GmbH & Co. KG, Neuenrade (DE)

(72) Inventors: Wolfgang Rüberg, Menden (DE); Nadine Schweinsberg, Neuenrade (DE); Matthias Tölle, Neuenrade (DE); Marvin Kind, Neuenrade (DE)

(73) Assignee: DR. HERFELD GMBH & CO. KG, Neuenrade (DE)

( * ) Notice: Subject to any disclaimer, the term of this patent is extended or adjusted under 35 U.S.C. 154(b) by 403 days.

(21) Appl. No.: 16/280,282

(22) Filed: Feb. 20, 2019

(65) Prior Publication Data

US 2019/0255493 A1 Aug. 22, 2019

(30) Foreign Application Priority Data

Feb. 20, 2018 (DE) ..... 20 2018 100 933.8
Jan. 31, 2019 (DE) ..... 20 2019 100 576.9

(51) Int. Cl.
*B01F 7/00* (2006.01)
*B01F 7/16* (2006.01)
*B01F 7/18* (2006.01)
*B01F 15/00* (2006.01)
(Continued)

(52) U.S. Cl.
CPC ..... *B01F 7/00933* (2013.01); *B01F 7/00* (2013.01); *B01F 7/001* (2013.01);
(Continued)

(58) Field of Classification Search
CPC .. B01F 7/00933; B01F 7/00633; B01F 11/00; B01F 7/16; B01F 7/00208;
(Continued)

(56) References Cited

U.S. PATENT DOCUMENTS 2,149,142 A 2/1939 Jorgenson
3,262,680 A * 7/1966 Balazer ..... B01F 7/1605 366/207
(Continued)

FOREIGN PATENT DOCUMENTS

DE 3433693 A1 3/1986
DE 202013103591 U1 8/2013
(Continued)

OTHER PUBLICATIONS

Search Report dated Jul. 25, 2019 in related European application 19157179.3.

*Primary Examiner* — Charles Cooley
(74) *Attorney, Agent, or Firm* — Polson Intellectual Property Law, PC; Margaret Polson

(57) ABSTRACT

A mixing machine includes a mixing head and at least one connection means for connecting a mixing container containing material to be mixed to said mixing head for forming a closed mixing container. The mixing head, as part of a pivotable assembly, is pivotably mounted with respect to a frame such that the closed mixing container formed from the mixing head and the mixing container can be pivoted relative to the frame for performing the mixing process. The mixing head carries at least one rotationally-driven mixing tool. The mixing head comprises a head plate having a connecting flange molded thereon which is configured as an annular disc and comprises a planar contact surface. At least two ring seals of differing diameters are arranged in said contact surface of the connecting flange at a spacing between each other, such that mixing containers with different connection diameters of their mixing head side can be connected to said mixing head. The at least one connection means is configured for gripping mixing containers which differ in the diameter of their connection sides.

20 Claims, 11 Drawing Sheets

(51) Int. Cl.
*B01F 11/00* (2006.01)
*B01F 13/00* (2006.01)

(52) U.S. Cl.
CPC ..... *B01F 7/00208* (2013.01); *B01F 7/00275* (2013.01); *B01F 7/00633* (2013.01); *B01F 7/16* (2013.01); *B01F 7/161* (2013.01); *B01F 7/162* (2013.01); *B01F 7/1605* (2013.01); *B01F 7/18* (2013.01); *B01F 11/00* (2013.01); *B01F 11/0017* (2013.01); *B01F 13/00* (2013.01); *B01F 13/0098* (2013.01); *B01F 15/00* (2013.01); *B01F 15/00006* (2013.01); *B01F 15/00733* (2013.01); *B01F 15/00805* (2013.01); *B01F 2015/00084* (2013.01); *B01F 2015/00097* (2013.01)

(58) Field of Classification Search
CPC ..... B01F 15/00733; B01F 7/00275; B01F 7/1605; B01F 11/0017; B01F 13/00; B01F 7/001; B01F 13/0098; B01F 7/162; B01F 7/00; B01F 15/00; B01F 7/161; B01F 7/18; B01F 15/00006; B01F 15/00805; B01F 2015/00084; B01F 2015/00097
See application file for complete search history.

(56) References Cited

U.S. PATENT DOCUMENTS

| | | | | |
|---|---|---|---|---|
| 3,284,057 | A | 11/1966 | Duquette | |
| 4,042,221 | A * | 8/1977 | Myers | B01F 7/161 366/146 |
| 4,781,468 | A * | 11/1988 | Herfeld | B01F 7/162 366/213 |
| 8,678,639 | B2 * | 3/2014 | Tolle | B01F 3/18 366/200 |
| 8,979,354 | B2 | 3/2015 | Tolle et al. | |
| 9,950,301 | B2 | 4/2018 | Ruberg et al. | |
| 9,968,897 | B2 | 5/2018 | Tolle | |
| 10,071,351 | B2 | 9/2018 | Ruberg et al. | |
| 10,265,669 | B2 | 4/2019 | Ruberg et al. | |
| 2013/0286768 | A1 | 10/2013 | Pang | |
| 2019/0255493 | A1 * | 8/2019 | Ruberg | B01F 7/00933 |

FOREIGN PATENT DOCUMENTS

| | | | |
|---|---|---|---|
| EP | 0225495 | A2 | 6/1987 |
| WO | 9837954 | A1 | 9/1989 |
| WO | 2009/011202 | A1 * | 1/2009 |

* cited by examiner

MIXING MACHINE

RELATED APPLICATIONS

This application is a nonprovisional application claiming priority to German application number 20 2018 100 933.8, filed Feb. 20, 2018, and to German application number 20 2019 100 576.9, filed Jan. 31, 2019, which are both hereby incorporated by reference for all purposes herein.

BACKGROUND

The present disclosure relates to a mixing machine, comprising a mixing head and at least one connection means for connecting a mixing container, which contains the material to be mixed and is open on the connection side, to said mixing head for forming a closed mixing container. The mixing head, as part of a pivotable assembly, is pivotably mounted relative to a frame such that the closed mixing container formed from the mixing head and the mixing container can be pivoted relative to said frame for performing the mixing process, and which mixing head carries at least one rotationally driven mixing tool.

Such mixing machines are industrial mixers used for mixing bulk material, typically powdery bulk material, as is needed, for example, for creating plastic granulate mixtures or in the paint industry. These mixing machines have a mixing head which can be pivoted relative to a frame and which at the same time is used to close a mixing container. The mixing container contains the material to be mixed and is connected to the mixing head for mixing the material to be mixed contained therein. After connecting the container to the mixing head, a closed mixing container is formed out of the mixing head and the mixing container which contains the material to be mixed. The mixing head comprises connection means for connecting the container to the mixing head. Said connection means may be a circumferential connecting flange projecting radially outwards which is brought into contact with a complementary connecting flange of the mixing container. Spindle-type lifting units are used, for example, with which the connecting flange of the mixing container is pressed against the connecting flange of the mixing head with the interposition of a seal. These mixers are also referred to as container mixers because a mixing container containing the material to be mixed is connected to the mixing head in these mixing machines. The mixing head itself has a concavely curved bottom side which merges into the circumferential cylindrical wall, extends concentrically with the center axis of the mixing head, and carries the connecting flange on its free end. The mixing head carries at least one mixing tool whose drive shaft passes through the bottom of the mixing head.

The mixing head itself is pivotably mounted relative to the machine frame of the mixing machine for mixing in an overhead position relative to the mixing head, in which the mixing head is arranged at the bottom and the mixing container connected to it is arranged on the top. Said overhead position is necessary for the material to be mixed to come into contact with the at least one mixing tool carried by the mixing head. The rotationally-driven mixing tool is used to create a flow of mixing material inside the closed mixing space. Such an industrial mixer is known, for example, from EP 0 225 495 A2.

Since the closed mixing container is provided by closing the mixing container with the mixing head in such machines, these components are matched to one another with respect to the configuration of the interacting connecting flanges. This means that only mixing containers which have the same connection geometry can be connected to a particular mixing head. To achieve the desired mixing result, it is necessary that the mixing container contains a specific minimum level of material to be mixed. But it is often necessary to mix different batches from the amount of material to be mixed. For this purpose, mixing containers having different sizes and volumetric capacities are provided. Such mixing containers of different sizes may each have different connection geometries, particularly different diameters of the connecting flanges. If a company that uses such mixers uses mixing containers of different sizes, there must also be mixing machines in which the connection geometry of the respective mixing head matches the connection geometries of the various mixing containers. If mixing containers with different capacities and thus different connection geometries are needed such that the material to be mixed can be mixed in such a machine, investment costs are accordingly high.

The foregoing examples of the related art and limitations therewith are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tool and methods which are meant to be exemplary and illustrative, not limiting in scope. In various embodiments, one or more of the above described problems have been reduced or eliminated, while other embodiments are directed to other improvements.

Starting from the above background, an aspect of the present disclosure is to design a mixing machine of the type mentioned above in such a manner that mixing containers with connection flanges of different diameters, therefore mixing containers of different capacities, can be connected to the mixing head of such a mixing machine.

This is acheived by a mixing machine of the type mentioned above, wherein the mixing head comprises a head plate with a connecting flange configured as an annular disc having a planar contact surface, in which contact surface of said connecting flange at least two ring seals of different diameters are arranged at a spacing, such that mixing containers with different connection diameters on their mixing head connection side can be connected to said mixing head, and that the at least one connection means is configured to grip mixing containers having different diameters of their connection sides.

In this mixing machine, the connecting flange on the mixing head side is configured as an annular disc having a width such that at least two ring seals of different diameters are disposed thereon. These ring seals are spaced apart from one another. The diameter of each ring seal is matched to the diameter of the abutment flange of a mixing container which is different with respect to its connection geometry. This means that mixing containers of different sizes with respect to their diameter on the connection side can be connected to the mixing head. If two ring seals of different sizes are disposed on the connecting flange of the mixing head, mixing containers of different configurations regarding their diameters on their connection sides can be connected to said mixing head. It is quite possible that three or more ring seals can be disposed on the connecting flange of the mixing head. Although the same mixing tool can be used for mixing the material to be mixed in mixing containers of different sizes, it can be useful, if the difference in diameter is too great, to perform the mixing process in a mixing container with a larger diameter of its connection geometry with a different tool than mixing the material to be mixed in a mixing container with a smaller diameter on its connection side.

The at least one connection means for connecting the mixing container to the mixing head is configured for gripping mixing containers of different diameters and connecting them to the mixing head. Thus material to be mixed which is contained in mixing containers of different sizes can be mixed using the same mixing machine, wherein the mixing process is performed in the overhead position with the mixing head at the bottom and the mixing container, whose opening faces the mixing head, at the top. The mixing process can be supported by an oscillating motion due to the pivotable mounting of the mixing head to the frame.

The ring seals are typically disposed concentrically to one another and are likewise disposed concentrically to the drive shaft which extends through the bottom of the mixing head and carries at least one mixing tool. Also possible is a configuration of the mixing head in which the mixing tool is disposed eccentrically with respect to the bottom of the mixing head, wherein the ring seals in such a configuration are integrated concentrically to the center axis of the bottom of the mixing head in the connecting surface of the connecting flange.

According to some embodiments, the mixing head comprises a head plate which overall has a flat bottom side extending across its surface. In such a configuration, the inner side of the mixing head merges into the connecting flange. In such a design of the mixing head, the head plate is preferably (but not necessarily) a plate which also has a planar outer side extending parallel to the inner bottom side.

Activatable and/or non-activatable seals can be used as ring seals. A combination of such ring seals is also possible. Activatable ring seals are such seals which comprise a circumferential cavity and which inflate when a fluid, e.g. compressed air, is introduced into said cavity and then act in accordance with the pressure introduced into the circumferential cavity on the connecting flange of the mixing container. The cavities comprise a fluid connection through which the fluid used for activation is introduced. The fluid connection of pneumatically-activatable ring seals is connected to a compressed air source. Such activatable ring seals have the advantage that the sealing surface can be in flush alignment with the plane of the connecting surface of the connecting flange of the mixing head when not in use to prevent the accumulation of material. Another option is to move the ring seal via activation when the mixing head is cleaned, which causes any adhering material to chip off and facilitates the cleaning process.

Such a mixing machine may comprise, as connection means for connecting a mixing container to the head plate of the mixing head, two lifting devices which are arranged diametrically opposite with respect to the center axis of the head plate and are also part of the pivotable assembly. These lifting devices can be adjusted in the radial direction on the pivotable assembly, for example electromotively via a spindle drive for each of them. Each of these lifting devices comprises a lifting plate for engaging under the radially projecting connecting flange of a mixing container to be connected to the mixing head. By engagement of the lifting plate under the connecting flange of the mixing container and lifting said flange via the lifting devices, a mixing container is brought into contact with the contact surface of the connecting flange of the head plate. In addition, each lifting device may comprise a pivotable locking lever next to its lifting plate, such that said levers, when locked, act on the outside wall of a mixing container held by the lifting plate. Such locking levers secure the container position.

It is also useful to connect an insertion limiting device to the pivotable assembly of the mixing machine. This device limits the inserting motion of a mixing container such that it comes to a stop in a position where its connecting flange is in flush alignment with the ring seal integrated in the head plate of the mixing head, which seals the connection between the connecting flanges of the mixing container and the head plate. Like the lifting devices, said insertion limiting device can also be radially adjusted with respect to the center axis of the mixing head to be able to correctly position the insertion limiting device for containers having different diameters. In this respect, the insertion limiting device in this embodiment does not act on the underframe of the mixing container which carries rollers but on the wall of the mixing container. The insertion limiting device can in detail be configured as an adjustable container stop. A locking pin which secures the container stop in intended positions can be provided to protect the container stop drive, e.g. a pneumatically activatable piston-cylinder arrangement, wherein said locking pin can be adjusted transversely to the adjusting direction of the container stop. Impact movements by the mixing container are then not introduced into the piston-cylinder arrangement.

According to one embodiment, pneumatic adjusting devices are provided for adjusting the locking levers of the lifting devices of the container stop and the locking pin.

Although in principle, if mixing containers differing in diameter size are connected, then mixing tools adjusted to the respective diameter of the mixing container can be mounted on the drive shaft. However, some embodiments envisage that the mixing head carries a mixing tool with which the desired flow of mixing materials can be generated, which is mostly independent of the radial spacing of the side wall of the mixing container from the outer ends of the blades of the mixing tool. In such an embodiment, a mixing tool connected to the drive shaft is configured with respect to its size for the size of the smallest mixing container which can be connected to the mixing head. In this way, the mixing machine can be operated with a mixing container that has a greater diameter without having to change tools.

Such a mixing tool, which can be called a universal mixing tool with respect to the attachable mixing container sizes, comprises at least two similar mixing tool blades on a hub which connects the mixing tool to the drive shaft. The mixing tool blades each comprise a connecting section. The connecting sections are angled from the plane of the hub in opposite directions with respect to the longitudinal extension of the rotational axis. A mixing blade section is molded to the connection section and extends radially away from the hub and is angled in two directions with respect to the plane of the hub. Such a mixing tool is not only configured to introduce energy into the mixing tool, but also to subject the material to be mixed to a moment of motion in the axial direction away from the mixing tool but directed towards the rotational axis. The energy such a mixing tool introduces into the mixing tool due to the inclination of its mixing tool blades intensifies the mixing process, such that intermixing is not just dependent on the generation of a flow of mixing material, as is the case with other mixing tools.

Such a mixing tool in principle introduces the energy into the material to be mixed at two height levels which are spaced apart from one another in the extension direction of the rotational axis. This is achieved by providing one connecting section in each mixing tool blade, which connects the hub of the mixing tool, with a mixing blade section. The actual mixing work is performed by the mixing blade sections, even if the connecting section may have a mixing and/or energy input functionality depending on the configuration. The mixing blade sections extend radially outwards from the connecting section, wherein they may have a crescent-shaped curvature in the radial direction. The mixing blade sections themselves can have a planar design. A curved design is possible as well. If they are curved, the mixing blade section can transition into their respective connecting sections. Otherwise, the mixing blade sections are molded at an angle to the respective connecting sections. It is remarkable in this mixing tool that the mixing blade sections are inclined with respect to the plane of the hub. The mixing blade sections are angled with respect to the plane of the hub, which plane extends transversely to the rotational axis, in two directions: in the direction of rotation and radially towards the rotational axis. This means that the mixing blade sections have an inclined spatial position, both in the direction of rotation and in the radial direction. The angle of inclination of the mixing blade sections may be the same or different in both directions. A typical angle of inclination can be 10 to 15 degrees. The angle of inclination will be selected dependent on the material to be mixed and the intended rotational speed, since more or less energy is introduced into the material to be mixed depending on the angle of inclination. In a rotating drive of such a mixing tool, the inclination of the mixing blade sections introduces a moment matching the inclination into the particles of material to be mixed, wherein the moment of motion has a vectorial proportion corresponding to the inclination axially away from the mixing tool.

According to an embodiment of such a mixing tool, the front ends of the mixing tool blades pointing to one and the other direction of rotation are of an asymmetrical design with respect to a central longitudinal plane which intersects with the mixing blade section. This different contour on the two front ends of a mixing blade section also allows exerting an influence on energy input. Due to the asymmetrical configuration of the mixing blade section, the energy input into the material to be mixed when rotating in the one direction differs from the energy input when rotating in the other direction.

Regardless of whether the mixing blade sections are asymmetrical in a top view with respect to said central longitudinal plane mentioned above or not, the front side pointing into the one direction of rotation or a section thereof can be configured as a cutting edge, while the other front end is blunt. If such a mixing tool is operated with its cutting edge facing the direction of rotation, the material to be mixed is in addition homogenized by the operation of the mixing tool. By alternating the rotating operation inside a mixing container of a mixing machine and changing the rotational speed, the mixing process can be controlled and adjusted particularly well to the properties of the material to be mixed.

In addition to the exemplary aspects and embodiments described above, further aspects and embodiments will become apparent by reference to the accompanying drawings forming a part of this specification wherein like reference characters designate corresponding parts in the several views.

BRIEF DESCRIPTION OF THE DRAWINGS

The present disclosure is further described below with reference to the appended figures.

Figure 1:
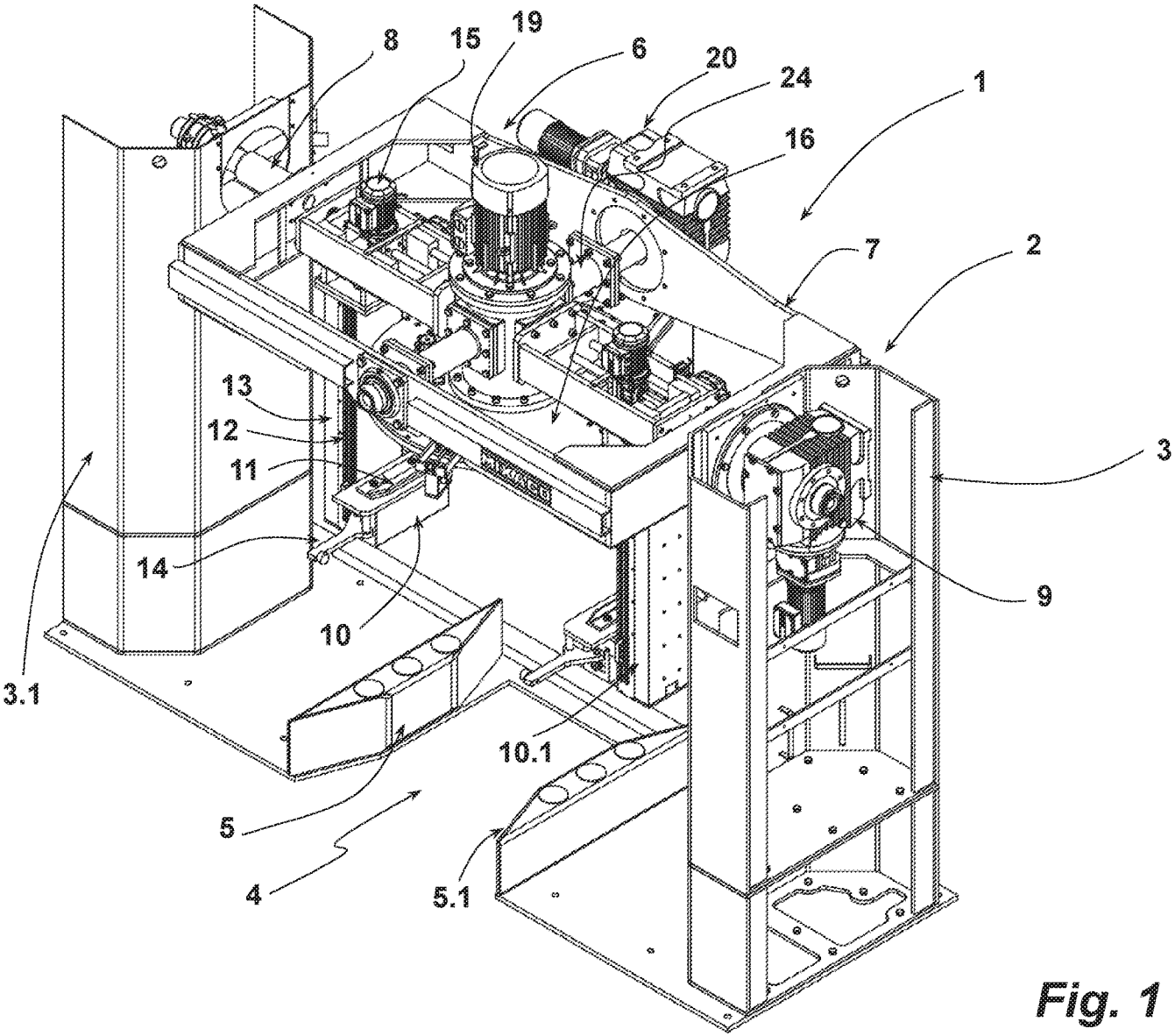
FIG. 1: is a perspective view of an industrial mixing machine.

Before further explaining the depicted embodiments, it is to be understood that the invention is not limited in its application to the details of the particular arrangements shown, since the invention is capable of other embodiments. It is intended that the embodiments and figures disclosed herein are to be considered illustrative rather than limiting. Also, the terminology used herein is for the purposes of description and not limitation.

DETAILED DESCRIPTION

A mixing machine 1 is used for industrial mixing of material to be mixed, for example plastic granules, located in a mixing container. The mixing machine 1 has a frame 2 which is provided by two columns 3, 3.1 in the embodiment shown in FIG. 1. A container entryway 4 is located in the bottom area between the columns 3, 3.1. The container entryway 4 is separated from the columns 3, 3.1 on each of its sides by a side wall 5, 5.1. The two columns 3, 3.1 are interconnected in their top sections via a pivotable assembly 6. The pivotable assembly 6 includes a frame component 7 with a pivot shaft 8 fastened to its two narrow sides. The pivot shaft 8 is mounted in the columns 3, 3.1. The column 3 houses an electromotive drive 9, with which the pivotable assembly 6 can be pivoted about the axis of the pivot shaft 8.

Two lifting devices 10, 10.1 configured as spindle-type lifting units are part of the pivotable assembly 6. The lifting devices 10, 10.1 are of identical construction. The general structure of the lifting device 10 is described below. These statements apply likewise to the lifting device 10.1. The lifting device 10 has a lifting plate 11 as part of a lifting plate unit which can be moved in the vertical direction by a spindle 12. Another plate which is beveled towards the container flange is located on the lifting plate. This plate centers the container when it is lifted. The lifting plate unit is guided on a guide 13. The spindle 12 is driven by an electric motor. The spindle 12 can be used to adjust the lifting plate unit in the vertical direction. FIG. 1 shows it in its lowest position. A further part of the lifting plate unit is a locking lever 14, which can be pivoted about a vertical pivoting axis from its base position shown in FIG. 1 towards the mixing container receptacle. By pivoting the locking lever 14, a mixing container inserted in the container entryway 4 can be locked. The locking lever 4 acts on the outer wall of such a mixing container. The lifting device 10 can be moved via an electric motor 15 as part of the pivotable assembly 6 in the longitudinal extension direction of the pivot axis of said pivotable assembly 6. The electric motor 15 drives one spindle drive for this purpose.

The pivotable assembly further includes a mixing head, the top side (outer side) of which is visible in FIG. 1.

Figure 2:
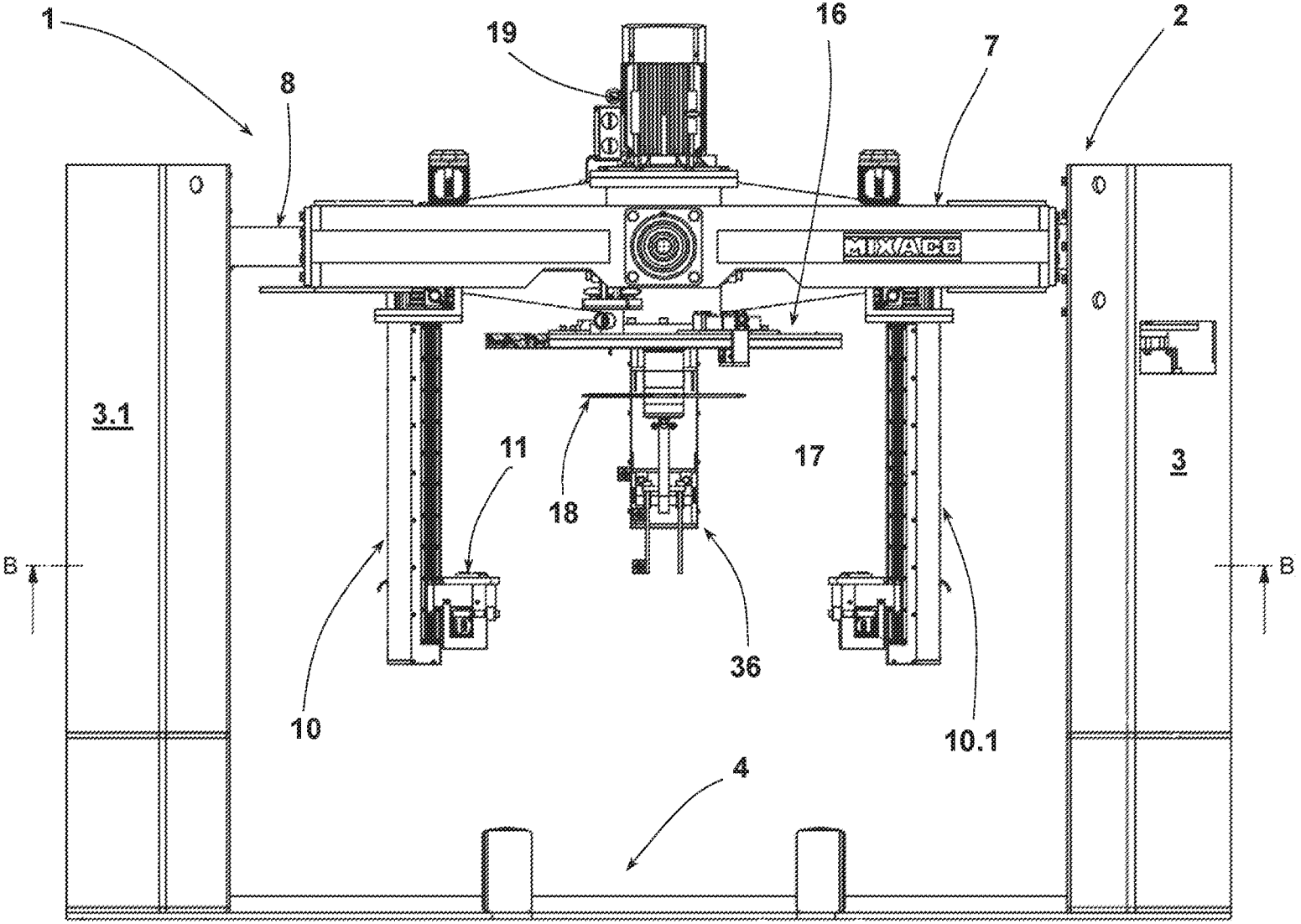
FIG. 2: is a front view of the mixing machine of FIG. 1.

The configuration of the mixing head 16 can be seen in the front view of the mixing machine 1 shown in FIG. 2. The mixing head 16 of the mixing machine 1 is configured as a cover for closing the mixing container which is open at its top side. The mixing head 16 includes a head plate 17. This is described in more detail with reference to FIGS. 3 to 5 below. A part of the mixing head 16 is a mixing tool 18, which is spaced apart from the bottom side of the head plate 17 visible in FIG. 2 and driven by an electric motor 19. The drive shaft of the electric motor 18 passes through the head plate 17.

Figure 3:
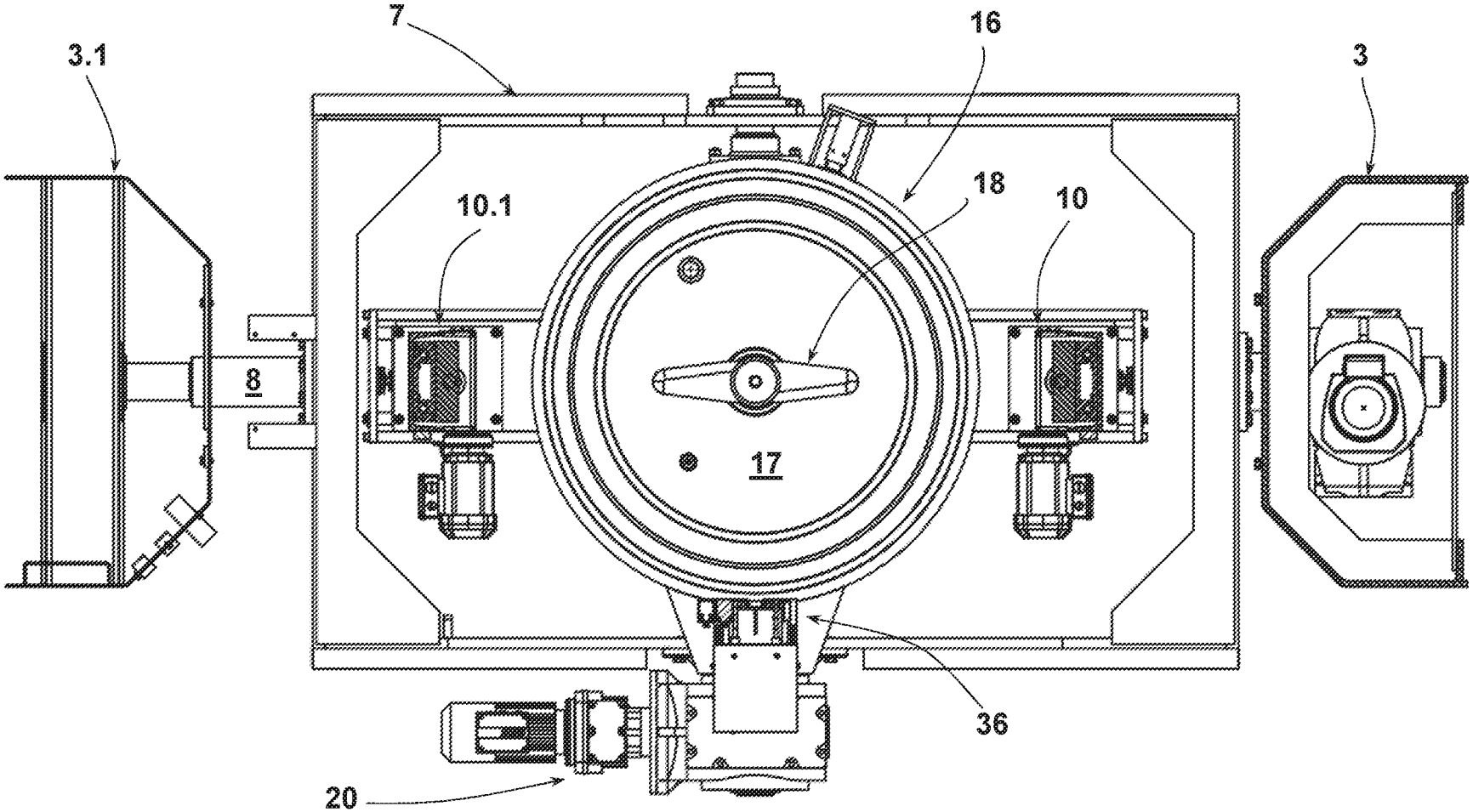
FIG. 3: is a sectional view taken along the line B-B of FIG. 2 with a bottom view of the pivotable assembly of the mixing machine.

The arrangement of the mixing head 16 with respect to the frame component 7 which carries it and the two lifting devices 10, 10.1 can be seen from the bottom view of the pivotable assembly 6 of FIG. 3. The mixing head 16 with the two lifting devices 10, 10.1 is gimbaled inside the frame component 7. The mixing head 16 with its two lifting devices 10, 10.1 can be pivoted about a rotational axis extending transversely to the pivot axis of the frame component 7 by a pivot drive 20. As a result, the mixing head 16 can be pivoted about two axes which are at a right angle to one another when the mixing machine 1 is in operation. This allows carrying out a mixing process in which a mixing container connected to the mixing head 16 performs a multidimensional oscillating motion.

In an embodiment not shown in the figures, the pivotable assembly can only be pivoted relative to the frame via the pivot shafts described above. In this design, the pivotable assembly is not gimbaled, which is why the frame component of the embodiment shown in the figures is not present in this design.

Figure 4:
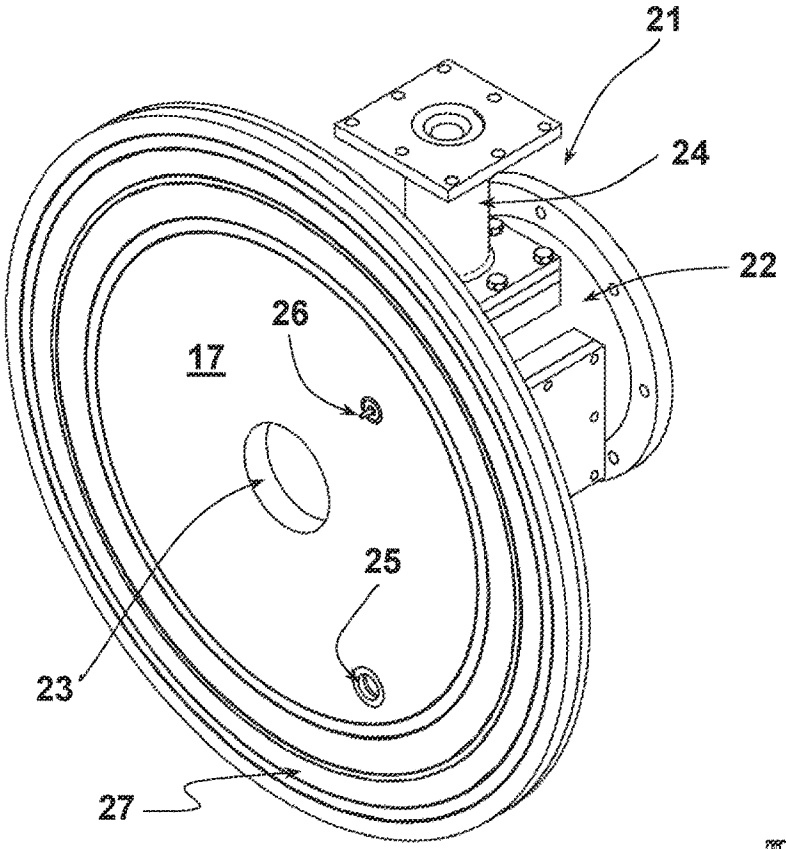
FIG. 4: is a perspective view of only the head plate of the mixing head as part of a head plate assembly.

The head plate 17 of the mixing machine 1 is a rotationally symmetrical disc (see FIG. 4), which is part of the head plate assembly 21. A cylinder piece 22, through which the drive shaft for driving the mixing tool 18 is guided, is fastened to the outside of the head plate 17. The drive shaft passes through the center of the head plate 17 in which a drive shaft passage 23 is incorporated for this purpose. As can be seen in FIG. 4, opposing adapter shafts 24 are fastened to the shell surface of the cylinder piece 22. These are used to receive the mixing head 16 in the present geometry. Furthermore, an opening 25 for a suction flow is provided in the head plate 17. The head plate 17 further carries a temperature sensor 26.

Figure 5:
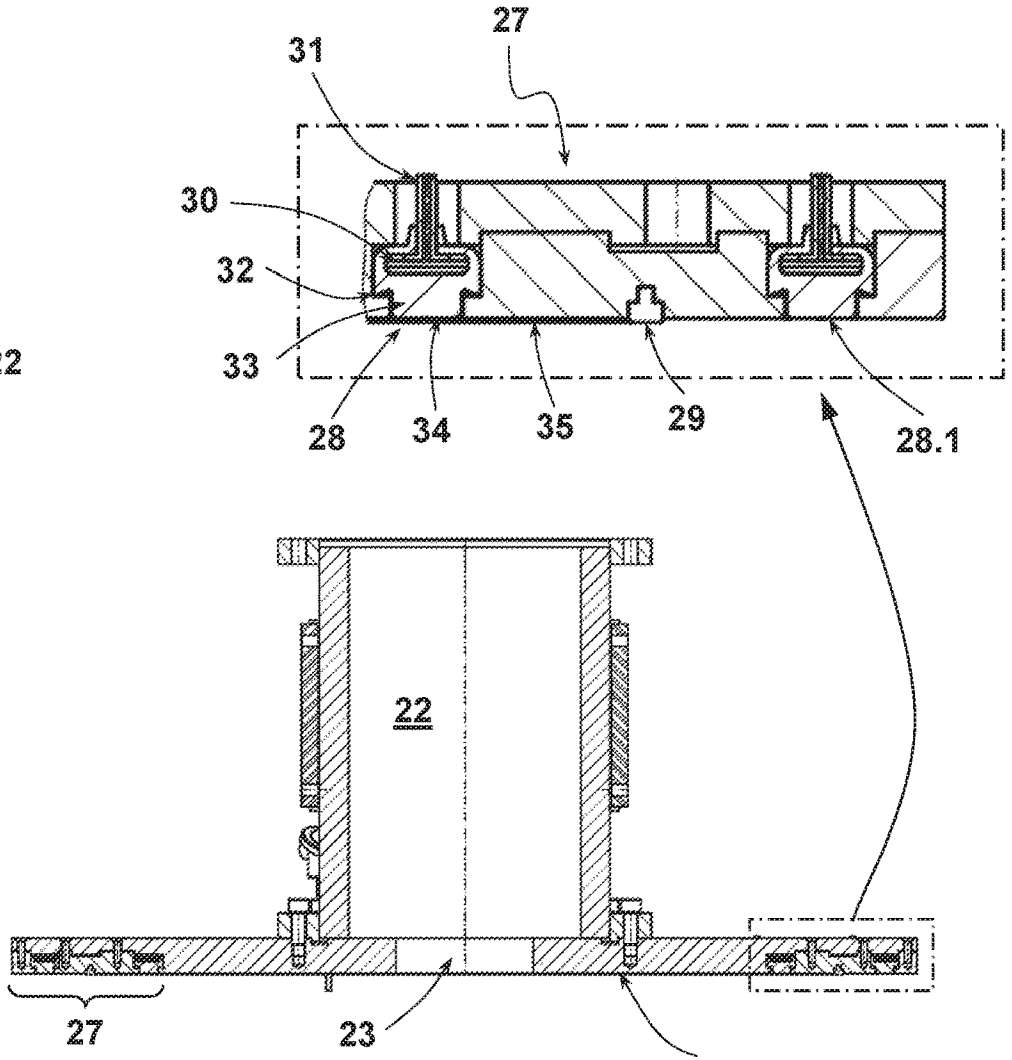
FIG. 5: is a sectional view through the head plate assembly of FIG. 4.

The head plate 17 is configured as a planar plate, as can be seen in the sectional view of FIG. 5. The outer edge region represents a connecting flange configured as an annular disc. The connecting flange has the reference symbol 27 in FIG. 5. The top side of the connecting flange 27, which faces away from the cylinder piece 22, is a contact surface for mixing containers to be connected to the mixing head 16 or its head plate 17, respectively. Three ring seals are integrated in the contact surface of the connecting flange 27, as is visible in the detail view of FIG. 5. Two of the seals are activatable ring seals 28, 28.1. They are disposed concentrically and at a spacing from each other and concentrically surround the drive shaft passage 23 and thus the center axis of the head plate 17. Another ring seal 29, which is non-activatable, is located between these two activatable ring seals 28, 28.1. The activatable ring seals 28, 28.1 each have a circumferential cavity 30 and a fluid connection 31 with which they are connected to a compressed air source (not shown). The ring seals 28, 28.1 are inflatable and sit in a groove 32 which is undercut from the direction of the contact surface of the connecting flange 27. The outer side 34 of the portion 33 of the ring seals 28, which portion projects into the opening of the groove, is flush with the contact surface 35 of the connecting flange 27 when the ring seal 28 is not activated. If the seal is inflated by introducing compressed air into the circumferential cavity 30 and thus activated, the outer side 34 bulges somewhat out of the circumferential groove opening if no abutment is in contact with the outer side 34 of the ring seal 28. The explanation above is made based on the ring seal 28, for which the respective reference symbols can be found in the figures. For the sake of clarity, these features are not shown in the figures for the ring seal 28.1.

Due to the radial spacing of the ring seals 28, 29, 28.1, mixing containers whose connecting flanges on their connection sides and therefore whose connection sides have different diameters can be connected to the head plate 17 of the mixing head 16. For this reason, the lifting devices 10, 10.1 can be radially adjusted relative to the head plate 17 by the spindle drive described above.

Figure 6:
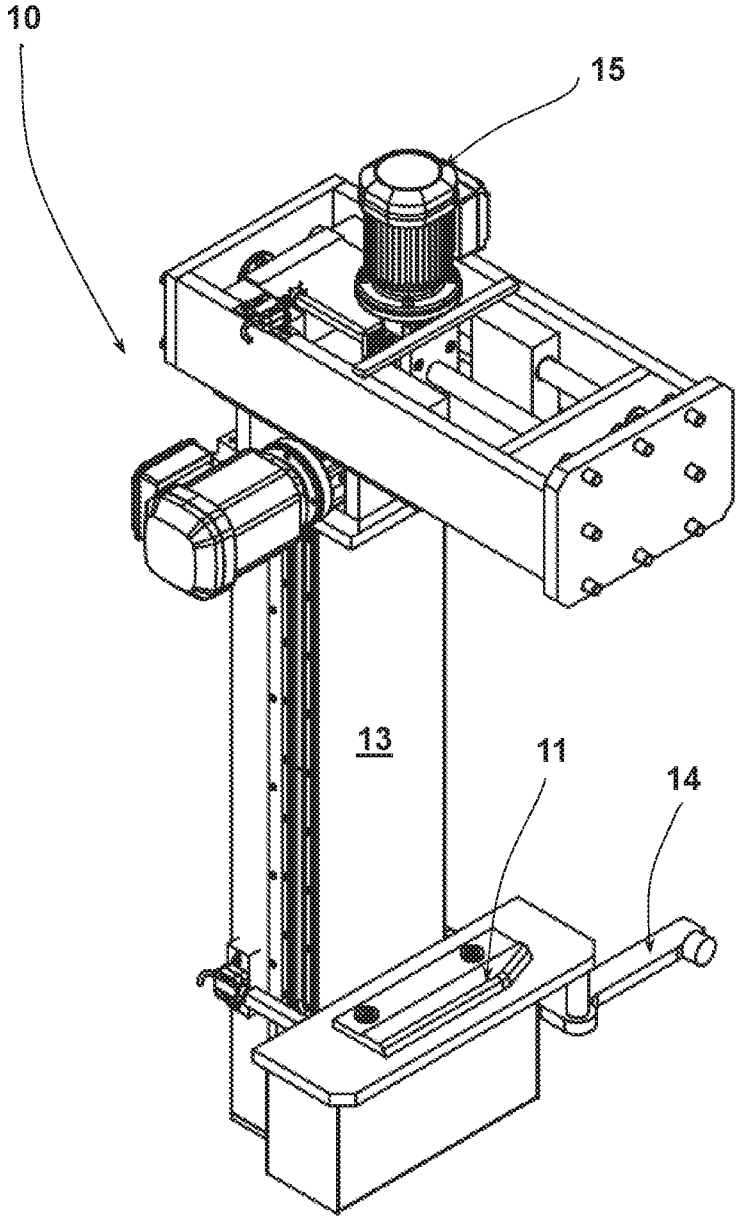
FIG. 6: is a perspective view of the two lifting devices of the mixing machine of FIG. 1.

FIG. 6 shows a perspective view of the lifting device 10.1. The parts already described with reference to FIG. 1 are identified by their reference symbols.

Figure 7:
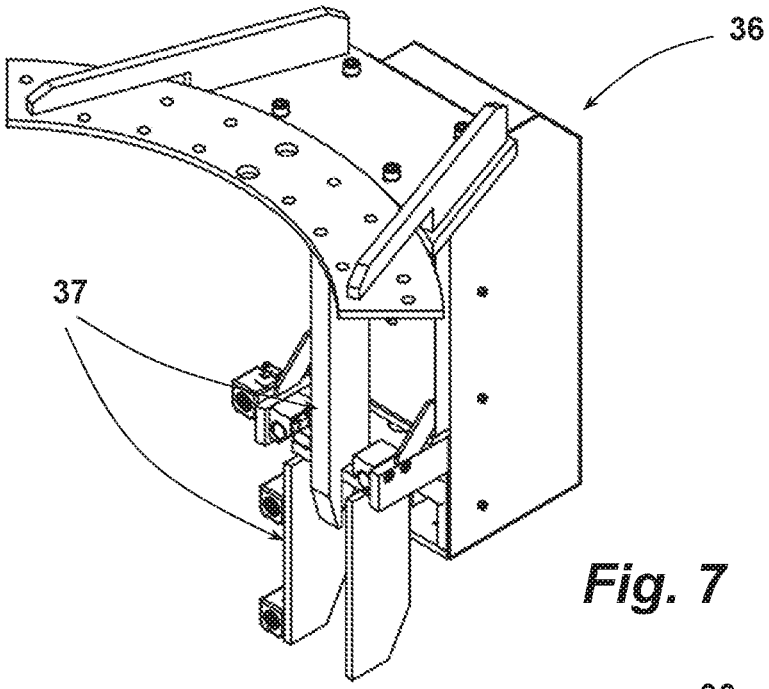
FIG. 7: is a perspective view of only an insertion limiting component of the mixing machine.
Figure 8:
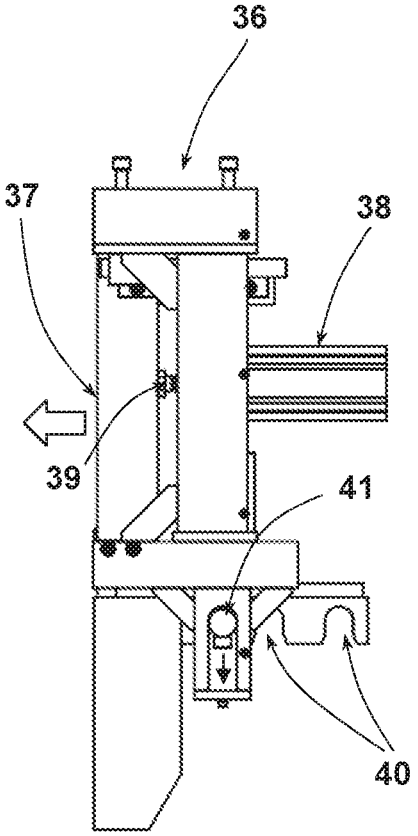
FIG. 8: is a side view of the insertion limiting component of FIG. 7 in a first position.

Furthermore, a part of the pivotable assembly 6 is an insertion limiting device, which is provided by an insertion limiting component 36 in the mixing machine 1. A perspective view of the insertion limiting component 36 is shown in FIG. 7. FIG. 3 shows the arrangement of this component 36 relative to the mixing head 16 and the two lifting devices 10, 10.1. The insertion limiting component 36 has a container stop 37 which can be radially adjusted to the center axis of the head plate 17. The container stop 37 is provided in the embodiment shown by three vertically extending plate-like components, wherein one of the narrow sides of the plate-like components faces the container entryway 4. The insertion limiting device provided by the insertion limiting component 36 is used for adjusting mixing containers of different diameters which are to be connected to the mixing head 16 of the mixing machine 1 for mixing the mixing material contained therein. The structure of the insertion limiting component 36 is visible in the side view shown in FIG. 9 with the side wall removed. The container stop 37 can be radially adjusted by a pneumatic cylinder 38. FIG. 8 shows the insertion limiting component 36 with its container stop 37 in the position which said component 36 is in when a mixing container with the greatest possible diameter is to be connected to the mixing head 16 of the mixing machine 1 and its connecting flange therefore acts on the ring seal 28.1 for sealing. The container stop 37 is connected to the pneumatic cylinder 38 by a piston rod 39. A locking pin 41 engaging in a locking member 40 is used to secure the component in the position shown in FIG. 8. The locking pin 41 can be adjusted transversely to the adjusting direction of the container stop 37, identified by a block arrow in FIG. 8, and protects the piston-cylinder unit for adjusting the container stop 37 from impacting mixing containers.

Figure 9:
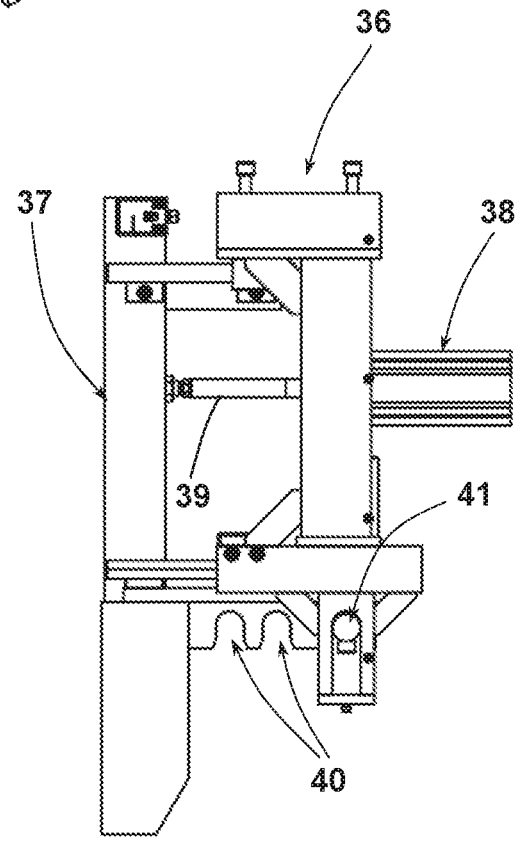
FIG. 9: is a side view of the insertion limiting component of FIGS. 7 and 8 in a second position.

FIG. 9 shows the insertion limiting component 36 in its extended position, which its container stop 37 is in when a mixing container whose connecting flange acts on the inside ring seal 28, the diameter of said mixing container therefore being smaller than the one whose connecting flange acts on the ring seal 28.1 for sealing, is to be connected to the mixing head 16 of the mixing machine 1. The locking pin 41 is located in a different recess of the locking member 40 for securing this position. The locking pin 41 can also be activated by a pneumatic cylinder to remove it from its position where it engages in a recess of the locking member 41 for adjusting the container stop 37 (not visible in the figures due to perspective). FIG. 8 indicates this adjusting movement by an arrow next to the locking pin 41.

Figure 10:
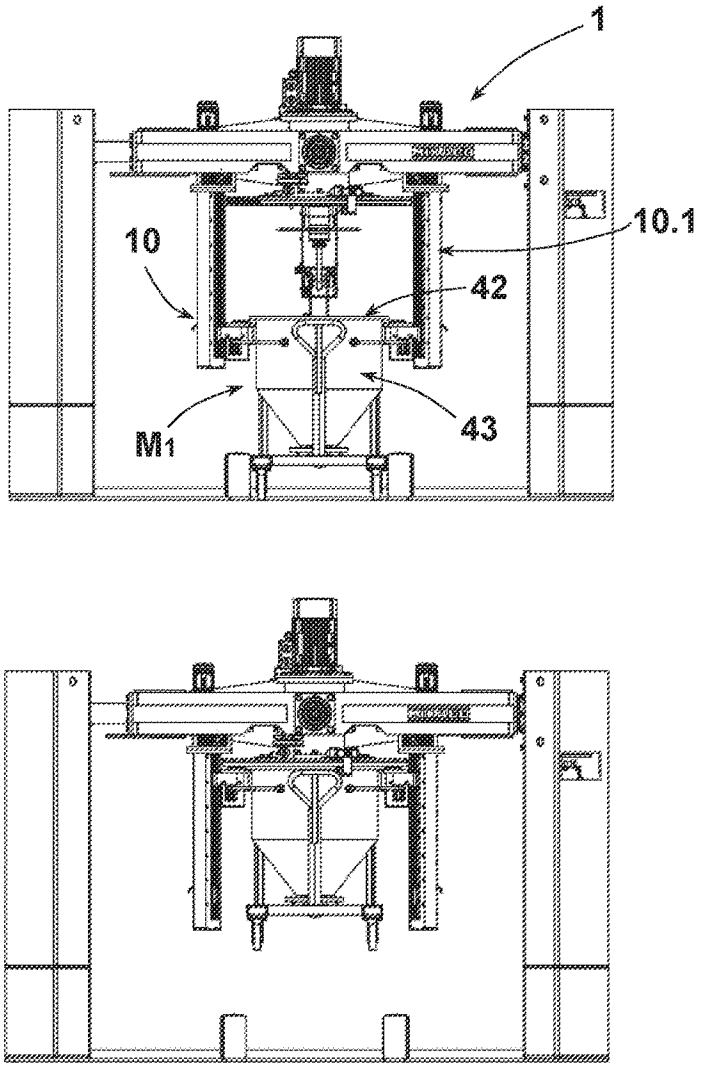
FIG. 10: shows two front views of the mixing machine with a mixing container of a first mixing container size inserted in its container receptacle (top view) and with the mixing container lifted by the lifting devices and connected to the mixing head (bottom view)

The top illustration in FIG. 10 shows the mixing machine 1 when receiving a mixing container $M_1$ with a smaller diameter. In the position shown at the top of FIG. 10, the lifting plates 11 of the two lifting devices 10, 10.1 have engaged under the outwardly projecting annular flange 42 of the mixing container $M_1$. The mixing container $M_1$ has for this purpose been inserted into the container entryway 4 until a wall outer side 43 rests against the container stop 37, which is in the position shown in FIG. 9. The locking levers 14 are in locking position and also act on the wall outer side 43 of the mixing container $M_1$. When the lifting device 10, 10.1 is operated, the mixing container $M_1$ is lifted and its connecting flange 42 is moved until it contacts the head plate 17. The top side of the connecting flange 42 acts on the ring seal 28, which is activated when the connecting flange 42 of the mixing container $M_1$ rests against the contact surface 35 of the connecting flange 27 of the head plate 17 of the mixing head 16. The process of mixing the material in the mixing container $M_1$ starts in the position shown at the bottom of FIG. 10. The pivotable assembly 6 is for this purpose first pivoted into an overhead position.

Figure 11:
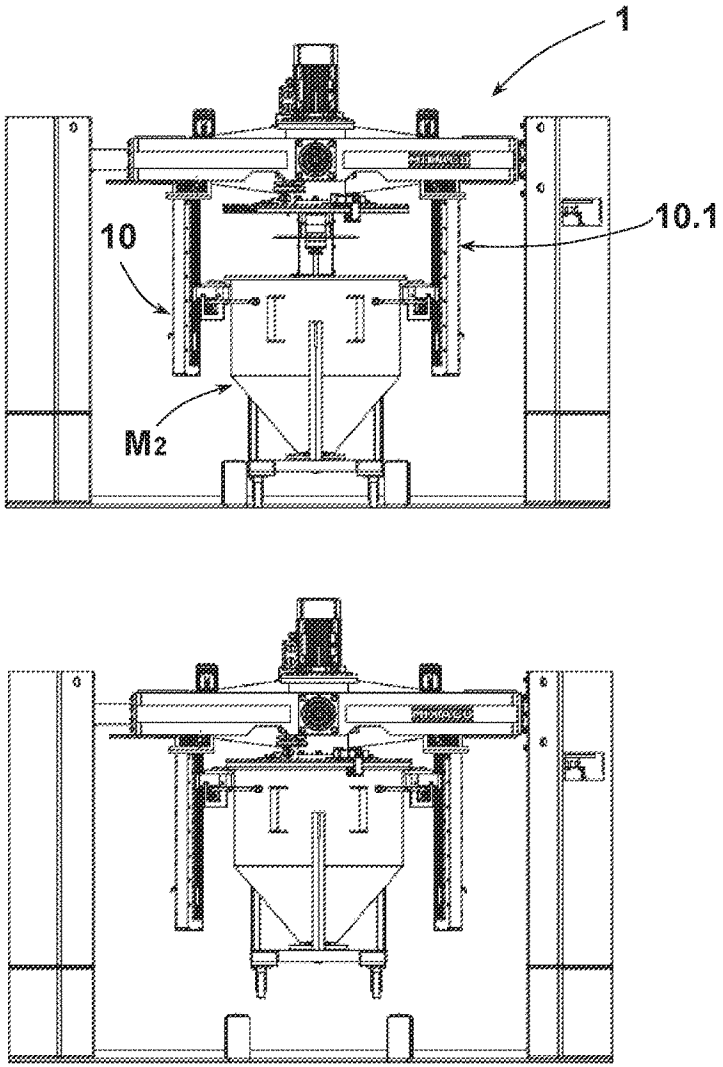
FIG. 11: shows two front views of the mixing machine with a mixing container of a second mixing container size inserted in its container receptacle (top view) and with the mixing container lifted by the lifting devices and connected to the mixing head (bottom view)

The same sequence of figures as in FIG. 10 are shown as an example in FIG. 11. But the mixing container $M_2$ has a greater diameter than the mixing container $M_1$. Accordingly, the insertion limiting component 36 was brought into its position shown in FIG. 8. The lifting devices 10, 10.1 are also in a position that is radially farther outwards than in FIG. 10.

Figure 12A:
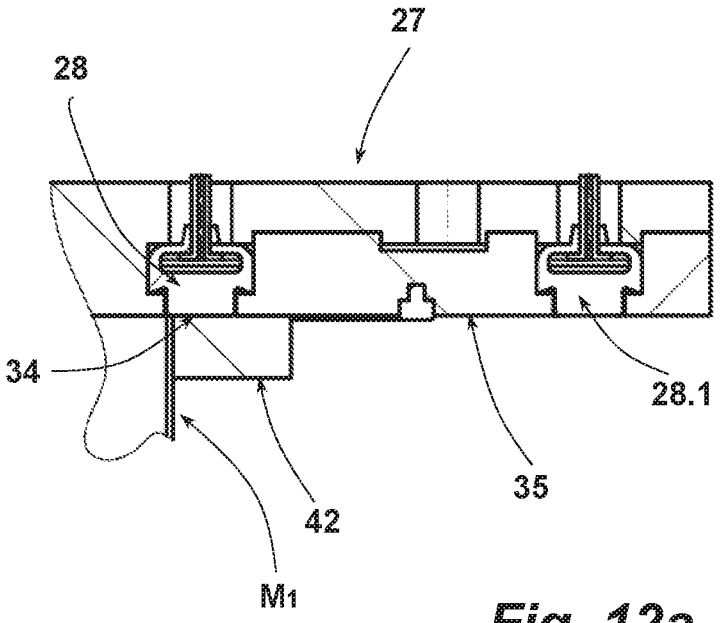
FIGS. 12*a*, 12*b*: show a cutout of the head plate of the mixing head of the mixing machine of the figures described above with a mixing container of a first size connected to it (FIG. 12*a*) and with a mixing container of a second size connected to it (FIG. 12*b*)

FIG. 12*a* shows a schematic view of the connection of the connecting flange 42 of the mixing container $M_1$ to the connecting flange 27 of the head plate 17. The connecting flange 42 acts on the outer side 34 of the ring seal 28 when said seal is activated.

Figure 12B:
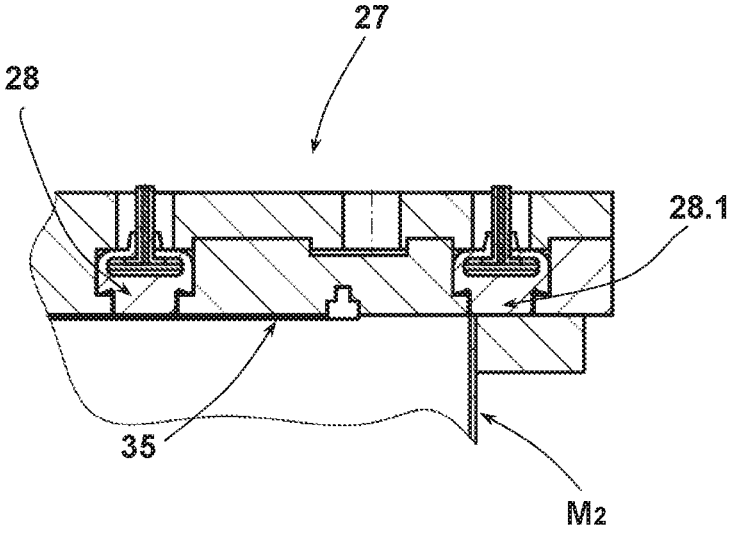

FIG. 12*b* shows the same partial view of the head plate 17 with the mixing container $M_2$ connected to it and its connecting flange acting on the ring seal 28.1.

A mixing tool 51 for an industrial mixing machine for mixing, for example, plastic granules in conjunction with the manufacturing of PVC is a bent part made of stainless steel in the embodiment shown. The mixing tool 51 includes a hub 52 with a shaft passage 53. The shaft passage 53 comprises two feather key seats 54, 54.1 which are arranged at an angular spacing of 90 degrees to one another. The tool shaft onto which the mixing tool 51 must be mounted comprises a feather key, such that the mixing tool 51 can be fastened on the tool shaft in two different positions relative to the feather key of the tool shaft. The hub 52 makes up the central component of the mixing tool 51. Two mixing tool blades 55, 55.1 are molded onto the hub 52 and are arranged diametrically opposite with respect to the rotational axis. The mixing tool blades 55, 55.1 are of similar construction and point-symmetrical to the rotational axis D (see FIG. 14).

Figure 13:
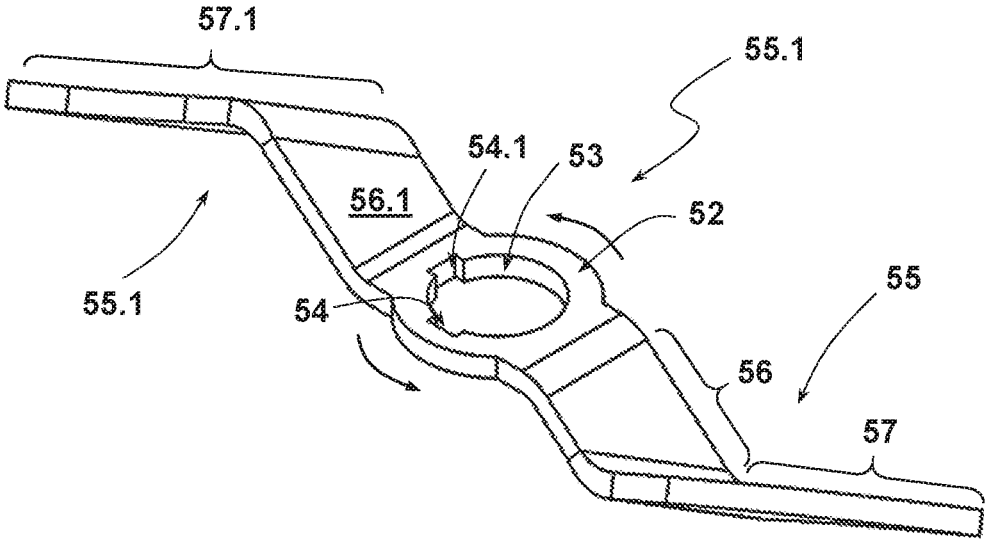
FIG. 13: is a perspective view of a mixing tool for a mixing machine.

The mixing tool blade 55 will be described in detail below. These statements apply likewise to the mixing tool blade 55.1. The mixing tool blade 55 includes a connecting section 56 and a mixing blade section 57. The connecting section 56 is molded at an angle to the hub 52. The angle of the connecting section 56 with respect to the plane of the hub 52 is typically between 30 and 45 degrees. In the embodiment shown, this angle $\alpha$ is 42 degrees (see also FIG. 15*b*). The bend line with which the connecting section 56 is angled with respect to the plane of the hub 52 is indicated by the reference symbol 58 in FIG. 14, which shows the operation of the mixing tool 51. The mixing blade section 57 is angled along a bend line 59 (see FIG. 14) relative to the plane of the connecting section 56. Unlike the bend line 58, bend line 59 does not run transversely to the longitudinal extension of the mixing tool blade 55, but at a specific inclination, which in the exemplary embodiment shown is about 33 degrees relative to the bend line that runs across. This angle is identified as 13 in FIG. 14. Due to this orientation of the bend line 59 by which the mixing blade section 57 is angled relative to the connecting section 56, the mixing blade section 57 is inclined relative to plane of the hub 52, both in the direction of rotation and in the radial direction. This has the effect that, when the mixing tool 51 is driven anticlockwise, as indicated by the arrows in FIG. 13, the material to be mixed or the particles of said material which impact the inclined mixing blade section 57 receive(s) a motion pulse directed upwards and radially toward the hub 52. When driven in the other direction of rotation (clockwise), the material to be mixed is given a motion pulse from the bottom side of the mixing blade section 57.1 shown in FIG. 13 that is directed downwards and radially outwards.

Since the mixing tool 51 has a point-symmetrical design with respect to the rotational axis D, the mixing blade section 57.1 of the mixing tool blade 55.1, when viewed in the direction of rotation, is inclined in the opposite direction from the mixing blade section 57.1 with respect to the connecting section 56.1. When the mixing tool 51 is driven anticlockwise, the material to be mixed is given a motion pulse directed downwards and outwards by the bottom side of the mixing blade section 57.1.

Figure 14:
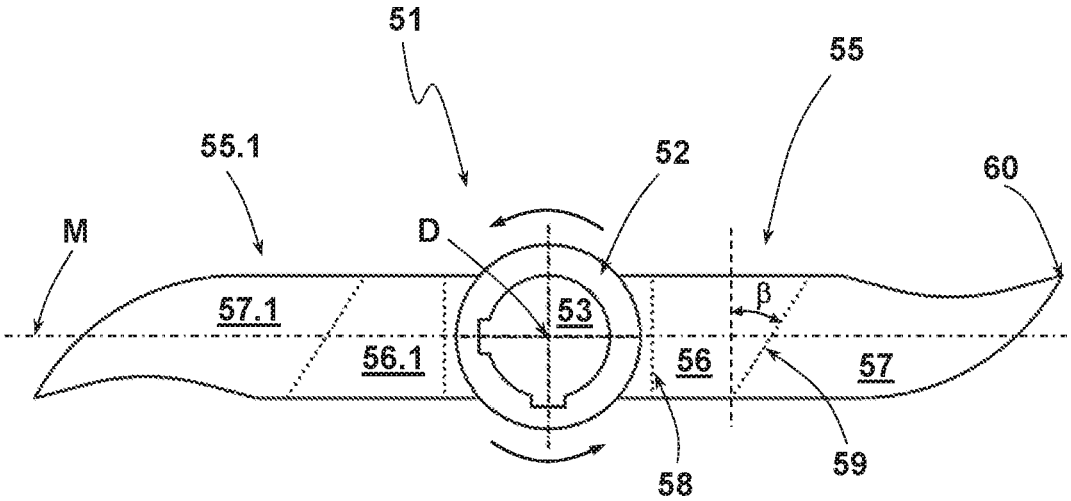
FIG. 14: is a top view of one rotation of the mixing tool from FIG. 13.

The top view of the operation of the mixing tool 51 in FIG. 14 makes it clear that the mixing blades 55, 55.1 are asymmetrical with respect to a central longitudinal plane, the extension of which is indicated in FIG. 14 by the reference symbol M. When the mixing tool 51 is driven clockwise, the front end pointing to the direction of rotation has a crescent-shaped configuration in the region of the mixing blade section 57 in the embodiment shown. This supports the energy input into the material to be mixed. In case of a clockwise rotation, this crescent-shaped configuration of the front end of the mixing blade section 57 supports the flow of material to be mixed away from a wall of a mixing container which encloses the mixing tool 51. The crescent-shaped section of said front end of the mixing blade section 57 is configured as a cutting edge in an embodiment not shown in the figures. Since the mixing blade section 57 is inclined, the upper edge of said front end points in the direction of rotation, thereby achieving a certain cutting or homogenization action.

The asymmetrical configuration of the mixing blade section 57 is caused by the fact that both end faces of the mixing blade section 57 are brought together in a mixing blade tip 60. The mixing blade tip 60 is located in the extension of the straight end face section molded to the hub 52 and pointing into the direction of rotation when driven anticlockwise. Starting from the mixing blade tip 60, the other end face is rounded, wherein a constant radius of curvature was selected in the embodiment shown, before said end face transitions into its straight end face section molded to the hub 52.

Figure 15A:
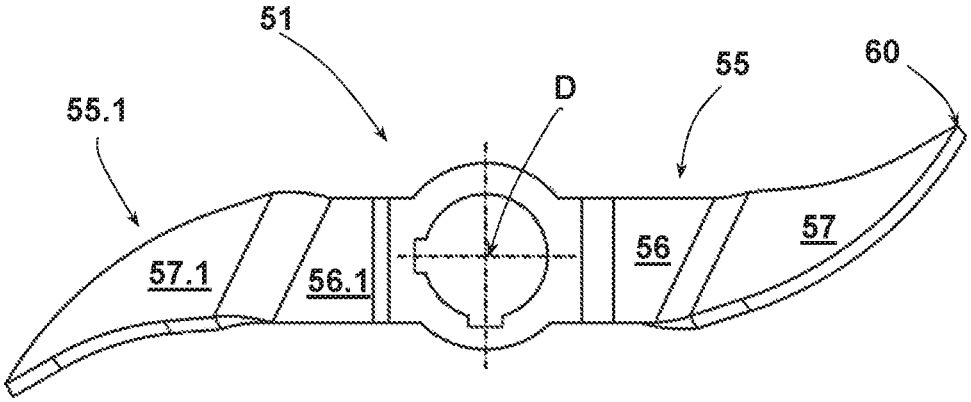
FIG. 15*a*-15*c*: show various views of the mixing tool of FIG. 13.
Figure 15B:
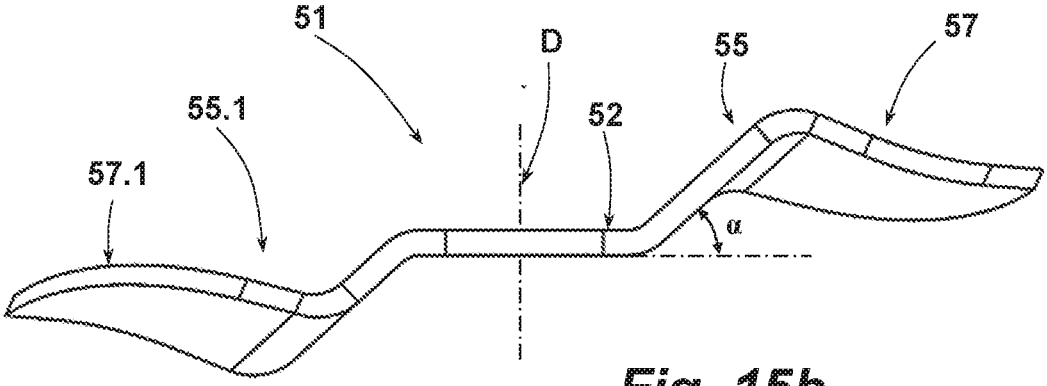
Figure 15C:
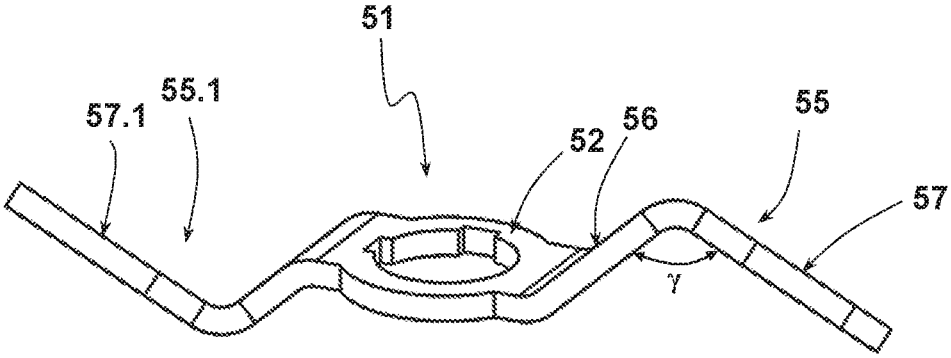

The mixing blade section 57 is angled with respect to the connecting section 56 along the bend line 59, in the embodiment shown at an angle of 110 degrees (see FIG. 15*c*).

FIGS. 15*a*-15*c* show different views of the mixing tool 51. FIG. 15*a* shows a top view of the mixing tool 51. FIG. 15*b* shows the mixing tool 51 viewed from the side towards the hub 52. The inclination of the mixing blade sections 57, 57.1 is clearly visible. It can also be seen that the mixing blade sections 57, 57.1 are in different planes with respect to the longitudinal extension of the rotational axis D. FIG. 15*c* shows a side view onto the front ends of the mixing blade sections 57, 57.1. The hub 52 can be seen in a perspective view due to the inclined configuration of the mixing tool 51.

Figure 16:
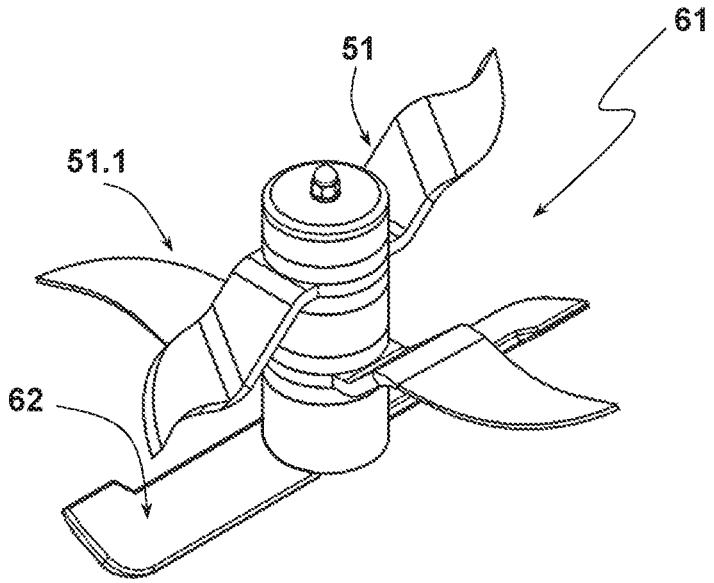
FIG. 16: is a mixing tool set with two mixing tools according to FIGS. 13 to 15 in a first arrangement of the two mixing tools relative to one another and with a bottom-clearing tool.

The mixing machine 1 can be operated with a mixing tool 51 as described above for mixing material to be mixed. The mixing time for one mixing process can be reduced if two mixing tools of this type instead of one mixing tool 51 are used, which then form a mixing tool set. Also possible is a configuration of a mixing tool set with more than two mixing tools. A perspective view of a mixing tool set made of two mixing tools 51, 51.1 is shown in FIG. 16. In this mixing tool set 61, both mixing tools 51, 51.1 are oriented in the same direction to one another, but offset by 90 degrees, on a tool shaft of a mixing machine otherwise not shown in detail. Such a type of mounting is made possible by the two feather key seats 54, 54.1, which are incorporated in the shaft passage 53 of the hub 52.

The mixing tool set 61 of the embodiment shown in FIG. 15 also includes a bottom-clearing tool 62 in addition to the two mixing tools 51, 51.1. It is seated on the same tool shaft together with the two mixing tools 51, 51.1. The bottom-cleaning tool 62 is directly adjacent to the bottom of a mixing container not shown in the figures. The bottom-cleaning tool 62 is inclined in the direction of rotation and has the purpose to lift material to be mixed from the area of the bottom of the mixing head 16 and feed it to the mixing tools 51, 51.1. This supports the energy input, since the mixing blade section 57.1 of each mixing tool 51, 51.1 moves material to be mixed towards the bottom of the mixing head 16, wherein the rotation of the bottom-cleaning tool 62 picks it up immediately and moves it towards the mixing blades 55, 55.1 of the mixing tools 51, 51.1.

The invention has been described with reference to illustrative embodiments. Without departing from the scope of the applicable claims, a person skilled in the art will see other options of implementing the invention, which do not have to be explained in detail herein. While a number of aspects and embodiments have been discussed above, those of skill in the art will recognize certain modifications, permutations, additions and sub-combinations therefore. It is therefore intended that the following appended claims hereinafter introduced are interpreted to include all such modifications, permutations, additions and sub-combinations, which are within their true spirit and scope. Each embodiment described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the invention has been specifically disclosed by embodiments and optional features, modification and variation of the concepts herein disclosed may be resorted to by those skilled in the art, and that such modifications and variations are considered to be within the scope of this invention as defined by the appended claims. Whenever a range is given in the specification, all intermediate ranges and subranges, as well as all individual values included in the ranges given are intended to be included in the disclosure. When a Markush group or other grouping is used herein, all individual members of the group and all combinations and sub-combinations possible of the group are intended to be individually included in the disclosure.

In general, the terms and phrases used herein have their art-recognized meaning, which can be found by reference to standard texts, journal references and contexts known to those skilled in the art. The above definitions are provided to clarify their specific use in the context of the invention.

LIST OF REFERENCE SYMBOLS

| | |
|---|---|
| 1 | Mixing machine |
| 2 | Frame |
| 3, 3.1 | Column |
| 4 | Container entryway |
| 5, 5.1 | Side wall |
| 6 | Pivotable assembly |
| 7 | Frame component |
| 8 | Pivot axis |
| 9 | Drive |
| 10, 10.1 | Lifting device |
| 11 | Lifting plate |
| 12 | Spindle |
| 13 | Guide |
| 14 | Locking lever |
| 15 | Electric motor |
| 16 | Mixing head |
| 17 | Head plate |
| 18 | Mixing tool |
| 19 | Electric motor |
| 20 | Pivot drive |
| 21 | Head plate assembly |
| 22 | Cylinder piece |
| 23 | Drive shaft passage |
| 24 | Adapter shaft |
| 25 | Opening |
| 26 | Temperature sensor |
| 27 | Connecting flange |
| 28, 28.1 | Ring seal |
| 29 | Ring seal |
| 30 | Cavity |
| 31 | Fluid connection |
| 32 | Groove |
| 33 | Portion |
| 34 | Outer side |
| 35 | Contact surface |
| 36 | Insertion limiting component |
| 37 | Container stop |
| 38 | Pneumatic cylinder |
| 39 | Piston rod |
| 40 | Locking member |

-continued

| LIST OF REFERENCE SYMBOLS | |
|---|---|
| 41 | Locking pin |
| 42 | Annular flange |
| 43 | Wall outer side |
| 51, 51.1 | Mixing tool |
| 52 | Hub |
| 53 | Shaft passage |
| 54, 54.1 | Feather key seat |
| 55, 55.1 | Mixing tool blade |
| 56, 56.1 | Connecting section |
| 57, 57.1 | Mixing blade section |
| 58 | Bend line |
| 59 | Bend line |
| 60 | Mixing blade tip |
| 61 | Mixing tool set |
| D | Rotational axis |
| M | Central longitudinal plane |
| $M_1$ | Mixing container |
| $M_2$ | Mixing container |

The invention claimed is:

1. A mixing machine comprising:

a mixing head and at least one connection means for connecting a mixing container containing material to be mixed to said mixing head, the mixing head and the mixing container together forming a closed mixing container;

the mixing head, as part of a pivotable assembly, is pivotably mounted with respect to a frame such that the closed mixing container formed by the mixing head and mixing container can be pivoted relative to said frame in performing a mixing process, and the mixing head carries at least one rotationally driven mixing tool;

wherein the mixing head comprises a head plate having a connecting flange molded thereon, the connecting flange is configured as an annular disc and comprises a planar contact surface;

wherein at least two ring seals of differing diameters are arranged in the planar contact surface of the connecting flange at a spacing between each other, such that mixing containers with different diameters on their mixing head connection sides can be connected to the mixing head;

wherein the at least one connection means is configured for gripping mixing containers which differ in the diameter of their mixing head connection sides.

2. The mixing machine of claim 1, wherein the ring seals are arranged concentrically.

3. The mixing machine of claim 2, wherein the ring seals are arranged concentrically with respect to a drive shaft carrying a mixing tool, and the drive shaft extends through the head plate of the mixing head.

4. The mixing machine of claim 1, wherein the head plate is configured as a plate having a planar inner side, and the planar contact surface of the connecting flange is part of the planar inner side of the head plate.

5. The mixing machine of claim 1, wherein at least one of the ring seals is a seal which can be activated by a fluid, the seal comprises a circumferential cavity with a fluid connection for introducing a fluid to activate the seal, and part of the seal which forms the circumferential cavity is seated in the undercut region of a circumferential undercut sealing ring seat.

6. The mixing machine of claim 1, wherein the at least one connection means for connecting the mixing container to the head plate of the mixing head comprises two lifting devices arranged diametrically opposite with respect to a center axis of the head plate, the lifting devices form components of the pivotable assembly, each lifting device has a lifting plate which can be adjusted towards the center axis of the head plate for engaging under a radially-projecting connecting flange of the mixing container, and each lifting device can be adjusted in a radial direction with respect to the center axis of the head plate.

7. The mixing machine of claim 6, wherein the lifting devices are configured as lifting spindles driven by an electric motor for adjusting the lifting plates.

8. The mixing machine of claim 6, wherein each lifting device is driven by a spindle drive for adjustability of the lifting devices in the radial direction.

9. The mixing machine of claim 6, wherein a pivotable locking lever is associated with each of the lifting plates of the lifting devices, and the pivotable locking levers are configured to act on an outer wall of the mixing container held by the lifting plates when in use.

10. The mixing machine of claim 9, wherein the pivotable locking levers can be adjusted pneumatically.

11. The mixing machine of claim 6, wherein the lifting plates comprise centering plates for centering the mixing container held by the lifting plates.

12. The mixing machine of claim 1, wherein the pivotable assembly comprises an insertion limiting device for connection of the mixing container inserted into the frame to the mixing head.

13. The mixing machine of claim 12, wherein the insertion limiting device comprises a container stop which can be radially adjusted with respect to a center axis of the head plate.

14. The mixing machine of claim 13, wherein the container stop can be adjusted pneumatically.

15. The mixing machine of claim 13, wherein the container stop is secured in various positions by a locking pin, and the locking pin can be adjusted transversely to an adjusting direction of the container stop.

16. A mixing tool for a mixing machine according to claim 1, comprising:

a hub having a rotational axis and a plane transverse to the rotational axis;

means for connecting the mixing tool to a rotationally-driven mixing tool shaft; and at least two mixing tool blades, each of the mixing tool blades comprises a connecting section connected to the hub and a mixing blade section molded to the connecting section, with the mixing blade sections extending radially away from the hub;

wherein at least two connecting sections are angled relative to the plane of the hub in opposite directions with respect to the longitudinal extension of the rotational axis;

wherein at least two mixing blade sections are inclined in two directions with respect to the plane of the hub.

17. The mixing tool of claim 16, wherein the mixing tool comprises two mixing tool blades located opposite one another with respect to the rotational axis of the hub.

18. The mixing tool of claim 16, wherein the at least two mixing blade sections are inclined in opposite directions relative to a direction of rotation of the hub.

19. The mixing tool of claim 16, wherein the mixing blade sections are connected at an angle to the connecting sections.

20. The mixing tool of claim 19, wherein the mixing blade sections are angled with respect to the connecting sections along bend lines, and each bends line is inclined relative to a cross-sectional line through the mixing blade section.

* * * * *